US011199203B2

(12) United States Patent
Kohn et al.

(10) Patent No.: US 11,199,203 B2
(45) Date of Patent: Dec. 14, 2021

(54) JET PUMP COMPRISING AN INTERNAL NOZZLE

(71) Applicant: SAFRAN AIRCRAFT ENGINES, Paris (FR)

(72) Inventors: Thierry Kohn, Moissy-Cramayel (FR); Benissa Boujida, Moissy-Cramayel (FR); Benjamin Lemenand, Moissy-Cramayel (FR); Alexis Pereira, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/792,640

(22) Filed: Feb. 17, 2020

(65) Prior Publication Data

US 2020/0263707 A1 Aug. 20, 2020

(30) Foreign Application Priority Data

Feb. 19, 2019 (FR) ..... 1901641

(51) Int. Cl.
*F04F 5/46* (2006.01)
*F04F 5/20* (2006.01)

(52) U.S. Cl.
CPC . *F04F 5/46* (2013.01); *F04F 5/20* (2013.01)

(58) Field of Classification Search
CPC ..... F04F 5/46; F04F 5/20; F04F 5/44; F04F 5/00
See application file for complete search history.

(56) References Cited

U.S. PATENT DOCUMENTS 3,460,746 A * 8/1969 Forsythe ..... F04F 5/461 417/174
3,460,747 A * 8/1969 Forsythe ..... F04F 5/466 417/189

(Continued)

FOREIGN PATENT DOCUMENTS

GB 1436697 A 5/1976
GB 2545688 A 6/2017

OTHER PUBLICATIONS merriam-webster.com/dictionary/tapered—see attached Tapered_ Definition of Tapered by Merriam-Webster pdf (Year: 2021).*

(Continued)

*Primary Examiner* — Devon C Kramer
*Assistant Examiner* — David N Brandt
(74) *Attorney, Agent, or Firm* — Pearne & Gordon LLP

(57) ABSTRACT

The invention relates to a jet pump collector comprising a convergent duct extending along the longitudinal axis (AX) and comprising an intake opening for a fluid to be withdrawn, this convergent duct having a restriction shape terminated by a reduced end having a smaller cross-section than its intake opening. This convergent duct is equipped with a tube (17) orientated perpendicular to the longitudinal axis longitudinal (AX), this tube (17) comprising an outer portion extending outside of the convergent duct and being terminated by an intake opening (31) for a propulsion fluid, and an inner portion extending in the convergent duct and comprising a plurality of distribution openings (18, 19) for the propulsion fluid which are orientated towards the reduced end.

7 Claims, 3 Drawing Sheets

(56) References Cited

U.S. PATENT DOCUMENTS

| | | | | |
|---|---|---|---|---|
| 5,087,175 | A * | 2/1992 | Raizman | F04F 5/20 417/196 |
| H1159 | H | 4/1993 | Roach | |
| 5,694,989 | A | 12/1997 | Kupelian | |
| 8,322,996 | B2 * | 12/2012 | McNeil | B64D 25/14 417/195 |

OTHER PUBLICATIONS

Preliminary Search Report issued in French Patent Application No. 1901641 dated Sep. 9, 2019.

* cited by examiner

JET PUMP COMPRISING AN INTERNAL NOZZLE

This application claims priority from French Patent Application 1901641 filed Feb. 19, 2019, the entire content of which is incorporated by reference herein.

TECHNICAL FIELD

The invention relates to a jet pump intended to equip a turbojet engine, such a pump enabling the entrainment of a fluid or a liquid of this engine through the expansion of a propulsion fluid for transporting it in a pipe in order to distribute it.

PRIOR ART

Such a jet pump, also called an ejector, makes it possible, for example to withdraw air from the engine using the air coming from a compressor of this engine, in order to distribute it to the cabin of the aircraft in order to refresh the air. Such jet pumps are used for multiple applications, for example for withdrawing oil from a bearing in order to send it to another component.

More generally, such a jet pump is a static device enabling suction, compression or mixing of gases, vapours or liquids through the expansion of a propulsion fluid or liquid which can be subsonic, supersonic, in the incompressible state of flow, and which provides the energy necessary for entraining the withdrawn fluid.

As can be seen in FIG. 1, such a pump 1 comprises a rectilinear main body 2, which is a hollow rotationally-symmetric part extending along a longitudinal axis AX. It includes an end defining an intake opening 3 for the withdrawn fluid and an opposite end defining a discharge opening 4 through which the mixture of the withdrawn fluid with the propulsion fluid is expelled.

The body 2 comprises an inlet portion, called the collector 5, the diameter of which corresponds to that of the intake opening 3, and which is restricted in order to be extended by a generally cylindrical portion which widens at the discharge opening 4, the diameter of which is close to that of the intake opening 3.

This pump 1 comprises, at its collector 5, a propulsion fluid supply duct 6 which is a tube passing radially through the wall of the body 2. This duct 6 has an outer end 7 having an opening for connection to a propulsion fluid supply pipe, and an inner end 8 centred on the axis of the body 2 and being orientated towards its discharge opening 4. This inner end 8 comprises a distribution opening 9, also called a nozzle, through which the propulsion fluid is injected into the body 2 in order to mix it with the withdrawn fluid and propel it.

In operation, the propulsion fluid entrains the withdrawn fluid by the Venturi effect downstream of the distribution opening 9, so that the expansion of this propulsion fluid supplies the withdrawn fluid with the necessary energy for its entrainment in order to propel it. The general shape of the body 2 ensures both that the withdrawn fluid is validly entrained by the propulsion fluid and that these two fluids are homogeneously mixed when they reach the discharge opening.

As shown in FIGS. 2 and 3, such a jet pump 1 is connected to a set of pipes 11 mounted on the outer surface of an engine housing 12. This housing 12, which has a generally rotationally-symmetric shape, is in turn surrounded by an engine cowl 13 which also has a rotationally-symmetric shape, having a larger diameter than the housing 12, so that the space in which the pipes 11 and the pump 1 are housed is an annular space defined internally by the housing 12 and externally by the cowl 13.

It is thus necessary that the jet pump 1 has a diameter less than half the difference between the diameters of the cowl 13 and the housing 12, and that its length is as short as possible in order to enable and simplify the incorporation of the assembly formed by the pump 1 and the pipes 11 in the restricted annular space that is defined by the housing 12 and the cowl 13.

The problem addressed by the invention is that of providing a solution for facilitating the incorporation of such a jet pump on an engine.

DESCRIPTION OF THE INVENTION

To this effect, the invention relates to a collector for a jet pump, comprising a convergent duct extending along the longitudinal axis and comprising an intake opening for a fluid to be withdrawn, this convergent duct having a restriction shape terminated by a reduced end having a smaller cross-section than its intake opening, this convergent duct being equipped with a tube comprising an outer portion extending outside of the convergent duct and being terminated by an intake opening of a propulsion fluid, and an inner portion extending in the convergent duct, this inner portion being orientated perpendicular to the longitudinal axis and comprising a plurality of distribution openings for the propulsion fluid, which are orientated towards the reduced end.

By multiplying the distribution openings, the cross-section of the propulsion fluid passage can be increased, but without having to increase the cross-section of the collector, which makes it possible to form a collector and a pump that are more compact than those of the prior art.

The invention also relates to a collector thus defined, wherein the inner portion of the tube has a rectilinear shape.

The invention also relates to a collector thus defined, wherein the inner portion of the tube has a tapered cross-section defining a tapered leading edge orientated towards the intake opening.

The invention also relates to a collector thus defined, wherein the inner portion of the tube has a drop-shaped cross-section.

The invention also relates to a collector thus defined, wherein the inner portion of the tube comprises two distribution openings.

The invention also relates to a collector thus defined, wherein the convergent duct has a conical shape.

The invention also relates to a collector thus defined, wherein the reduced end has, in cross-section, an area being half the area of the cross-section of the intake opening.

The invention also relates to a jet pump, comprising a collector thus defined, and in which the reduced end of the convergent duct is prolonged by a cylindrical portion which is in turn prolonged by a flare terminated by a discharge opening (23).

DETAILED DESCRIPTION

Figure 1:
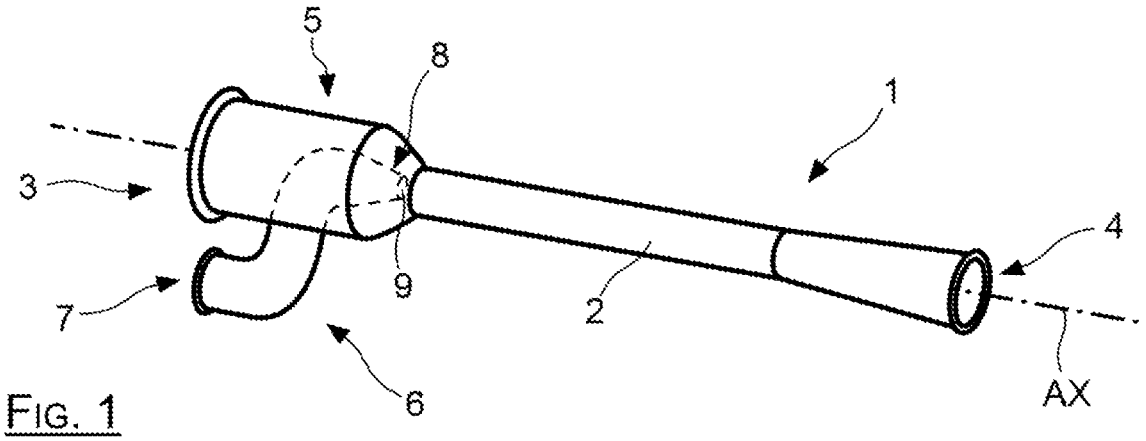
FIG. 1 PRIOR ART
FIG. 1 already described, is a perspective view of a known jet pump.
Figure 2:
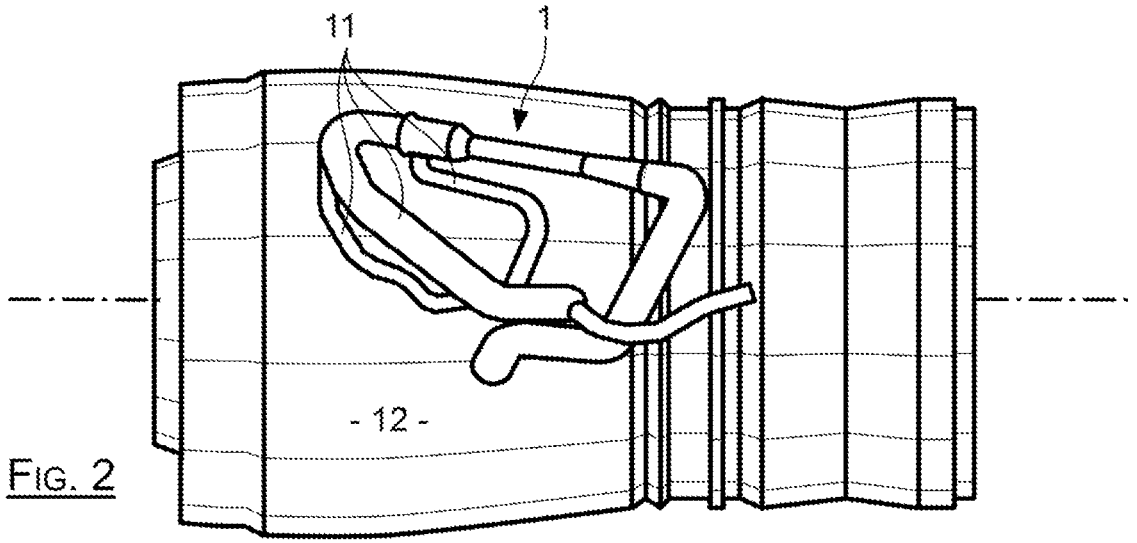
FIG. 2 PRIOR ART
FIG. 2 already described, if an assembly view showing the incorporation of a jet pump and its pipes on the outer surface of an engine housing.
Figure 3:
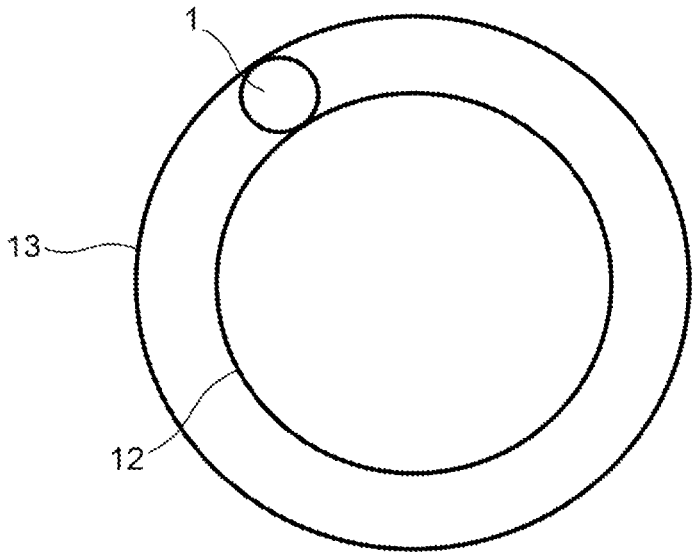
FIG. 3 PRIOR ART
FIG. 3 already described, is a sectional view of an engine showing the radially available space for incorporation of a jet pump.

The basic idea of the invention is to provide a tube comprising not just one distribution opening of given cross-section, but a plurality of openings, the sum of the cross-sections of which is greater than or equal to that of the distribution opening of a tube with single distribution opening according to the prior art.

In the figures, a jet pump 14 according to the invention comprises a body 16 equipped with a seamless, propulsion fluid supply tube 17 comprising a plurality of distribution openings 18 and 19, in this case two openings.

The body 16 as a hollow rectilinear part, in this case rotationally symmetric, extending along its longitudinal axis AX, comprising at one of its ends, a so-called collector portion 21 defining an intake opening 22, and at its other end, a discharge opening 23 via which the mixture of the withdrawn fluid with the propulsion fluid is expelled.

The collector 21 comprises a convergent duct 20 forming a restriction, in this case substantially conical, extending from the intake opening 22 to its reduced end 24, the diameter of which is significantly less than the diameter of the opening 22. The convergent duct 20 is extended at its end 24 by a cylindrical portion 26, this cylindrical portion in turn being extended by a flare 27 terminated by the discharge opening 23 of the pump.

Figure 5:
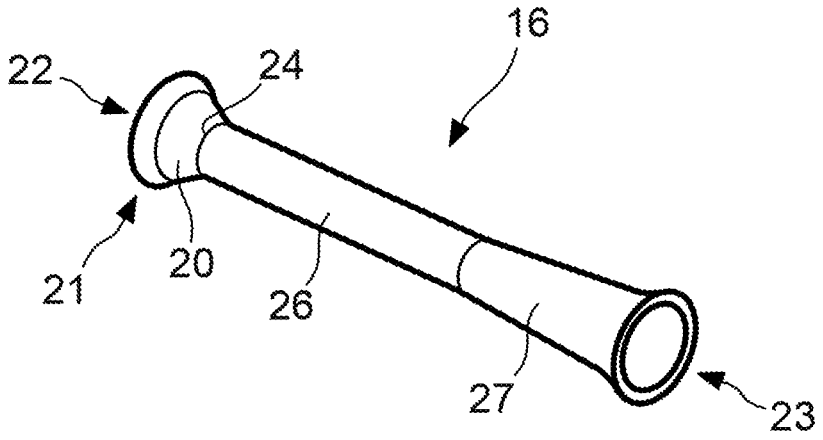
FIG. 5 is a perspective view of a jet pump body according to the invention.
Figure 6:
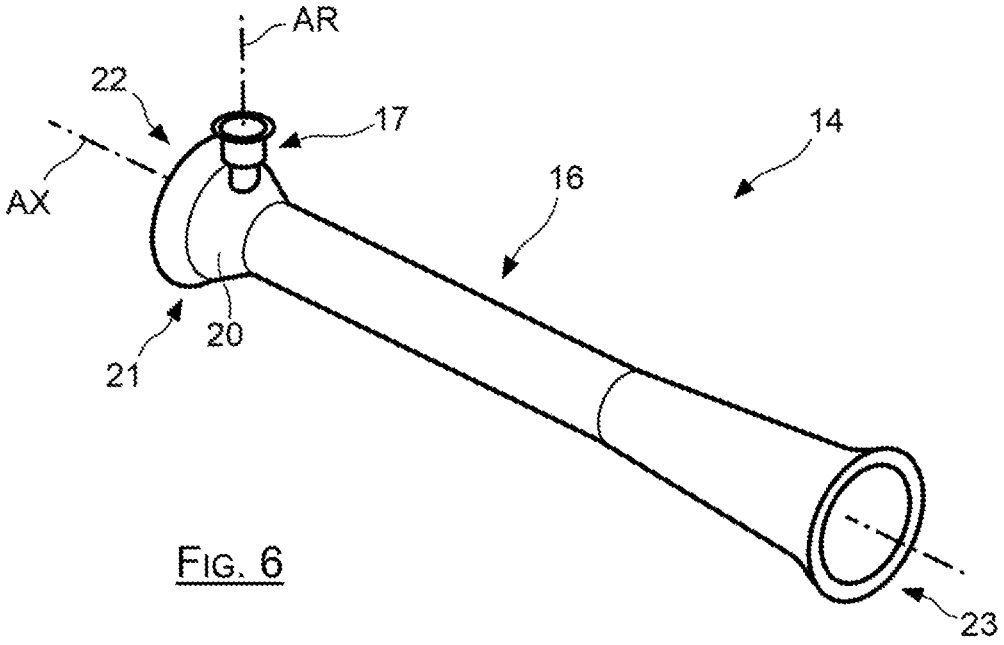
FIG. 6 is a perspective view of a jet pump according to the invention in its entirety.

The diameter of the cylindrical portion 26, which corresponds to the diameter of the reduced end 24 of the duct 20, is significantly less than the diameters of the intake and discharge openings, which are substantially identical. In the examples of FIGS. 5 and 6, the diameter of the cylindrical portion has a value half that of the diameter of the openings 22 and 23.

The tube 17 which provides the supply of propulsion fluid is a seamless duct, in this case rectilinear, extending along an axis AR. This tube 17 extends between a flared outer end 28 having a circular opening 31 for connection to a propulsion fluid supply pipe, and a terminal inner end 32. It equips the duct 20 of the collector 21, the wall of which it passes through, being positioned so that its axis AR extends radially with respect to the central axis AX of the duct 20. This tube 17 thus comprises an outer portion 17*a* situated outside the duct 20 and an inner portion 17*b* situated in this duct, having its end 32 against the inner face of the latter.

Figure 4:
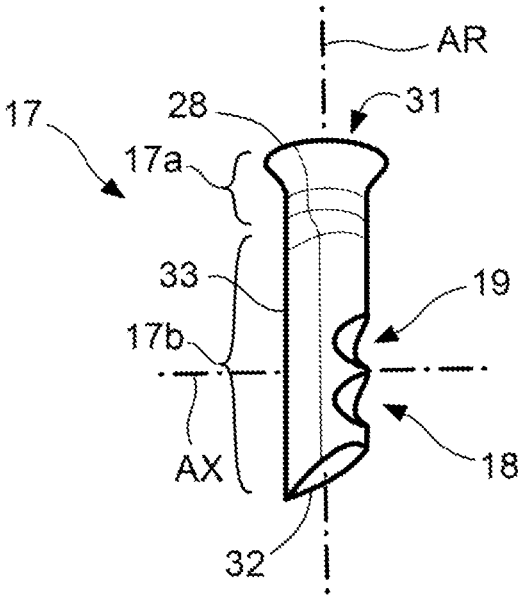
FIG. 4 is a perspective view of a jet pump tube according to the invention.

The inner end 32 has a bevelled shape shown in FIG. 4, with a bevel angle corresponding to the half-angle at the apex of the cone defined by the conical wall forming the collector 21. The inner end 32 is thus in abutting contact on the inner face of the duct 20 when the assembly is mounted to form the collector 21.

As can be seen in FIG. 4, the distribution openings 18 and 19 of this tube 17 each pass through the wall of the tube, each having an approximately circular contour. These two openings 18 and 19 have approximately the same cross-section, and they are orientated towards the discharge opening 23 of the pump when the tube is mounted. These openings are adjacent to one another along the axis AR of the tube, being situated on either side of the longitudinal axis AX of the duct 20 when the tube same.

The inner portion 17*b* of the tube 17 has, when viewed in cross-section with respect to the axis AR, a tapered shape approximating a drop of water, defining a tapered leading edge 33 orientated towards the intake opening 22, the openings 18 and 19 being situated opposite leading edge 33 with respect to the axis AR.

Due to this tapered cross-section, the tube 17 minimises the pressure losses introduced by its presence in the duct 20, with respect to the withdrawn fluid which passes through this duct of the collector, and which can then pass around it without significant disruption to its flow.

In a general manner, the choice of the tube having a straight inner portion and having a tapered cross-section provided with a plurality of distribution openings, makes it possible to obtain a collector of smaller dimensions in comparison with the collectors of the prior art that comprise a seamed tube terminated by a single distribution open that determines the diameter of the entirety of the pump. In other words, for a given cross-section of distribution opening, the choice of a straight tube having a plurality of openings for which the sum of the cross-sections is greater than or equal to the given distribution opening cross-section, makes it possible to dimension a more compact jet pump in terms of both diameter and length, and similarly more lightweight.

The invention claimed is:

1. A collector for a jet pump comprising a convergent duct extending along a longitudinal axis and comprising an intake opening for a fluid to be withdrawn, the convergent duct having a restriction shape terminated by a reduced end having a smaller cross-section than the intake opening, the convergent duct being equipped with a tube positioned between the intake opening and the reduced end, the tube comprising an outer portion extending outside of the convergent duct and being terminated by an intake opening for a propulsion fluid, and an inner portion extending in the convergent duct, the inner portion being orientated perpendicular to the longitudinal axis and comprising a plurality of distribution openings for the propulsion fluid which are orientated towards the reduced end, and wherein the inner portion of the tube has a tapered cross-section defining a tapered leading edge oriented towards the intake opening of the convergent duct.

2. The collector according to claim 1, wherein the inner portion of the tube has a rectilinear shape.

3. The collector according to claim 1, wherein the inner portion of the tube has a drop-shaped cross-section.

4. The collector according to claim 1, wherein the plurality of distribution openings consists of two distribution openings.

5. The collector according to claim 1, wherein the convergent duct has a conical shape.

6. The collector according to claim 1, wherein the reduced end has a cross-sectional area that is half a cross-sectional area of the intake opening.

7. A jet pump, comprising the collector according to claim 1, the collector having a cylindrical portion which is prolonged by a flare terminated by a discharge opening, wherein the reduced end of the convergent duct is prolonged by the cylindrical portion.

* * * * *